US011458054B2

(12) United States Patent
Gowda et al.

(10) Patent No.: US 11,458,054 B2
(45) Date of Patent: Oct. 4, 2022

(54) EXPANDABLE PATIENT SUPPORT APPARATUS AND METHOD

(71) Applicant: KAP MEDICAL, Corona, CA (US)

(72) Inventors: Raj K. Gowda, Corona, CA (US); Dan F. Rosenmayer, Corona, CA (US)

(73) Assignee: KAP MEDICAL, Corona, CA (US)

( * ) Notice: Subject to any disclaimer, the term of this patent is extended or adjusted under 35 U.S.C. 154(b) by 262 days.

(21) Appl. No.: 16/841,299

(22) Filed: Apr. 6, 2020

(65) Prior Publication Data

US 2021/0307982 A1 Oct. 7, 2021

(51) Int. Cl.

| | |
|---|---|
| ***A61G 7/057*** | (2006.01) |
| ***A47C 27/10*** | (2006.01) |
| ***A47C 27/08*** | (2006.01) |

(52) U.S. Cl.

CPC ..... *A61G 7/05776* (2013.01); *A47C 27/083* (2013.01); *A47C 27/10* (2013.01); *A61G 7/05769* (2013.01); *A47C 27/081* (2013.01); *A61G 2203/16* (2013.01); *A61G 2203/34* (2013.01)

(58) Field of Classification Search

CPC ..... A61G 7/05776; A61G 7/05769; A61G 2203/16; A61G 2203/34; A47C 27/081; A47C 27/082; A47C 27/083; A47C 27/10

USPC ..... 5/710, 713, 706, 655.3, 654, 644

See application file for complete search history.

(56) References Cited

U.S. PATENT DOCUMENTS

| | | | | |
|---|---|---|---|---|
| 7,260,860 | B2 * | 8/2007 | Chambers | A61G 7/0507 5/713 |
| 7,363,663 | B2 * | 4/2008 | Chambers | A61G 7/0514 5/722 |
| 7,461,425 | B2 * | 12/2008 | Chambers | A61G 7/05776 5/722 |
| 7,464,425 | B2 * | 12/2008 | Chambers | A61G 7/05776 5/739 |
| 7,565,710 | B2 * | 7/2009 | Chambers | A61G 7/0514 5/713 |
| 7,832,039 | B2 * | 11/2010 | Chambers | A61G 7/0507 5/713 |
| 7,845,032 | B2 * | 12/2010 | Chambers | A61G 7/05776 5/616 |

(Continued)

FOREIGN PATENT DOCUMENTS

| | | | | |
|---|---|---|---|---|
| EP | 2289477 | A1 * | 3/2011 | A61G 7/05776 |
| EP | 2954884 | A1 | 12/2015 | |
| WO | WO-2021207053 | A1 * | 10/2021 | A61G 7/05776 |

OTHER PUBLICATIONS

European Patent Office; International Search Report and Written Opinion; PCT Application No. PCT/US2021/025727 dated Jun. 22, 2021.

*Primary Examiner* — Robert G Santos

(57) ABSTRACT

A support surface includes a patient fluid support surface that includes a first set of inflatable portions having an adjustable width and a second set of inflatable portions having an adjustable length, the width and length both adjustable by changing an amount of fluid in each of the first and second inflatable portions and a controller housing that includes a user interface device and a controller operative to provide control of both inflating and deflating of the first and second set of inflatable portions in response to electronic control signals from the user interface device.

10 Claims, 8 Drawing Sheets

(56) References Cited

U.S. PATENT DOCUMENTS

| | | | | |
|---|---|---|---|---|
| 2006/0026767 | A1* | 2/2006 | Chambers | A61G 7/0507 5/713 |
| 2006/0026768 | A1* | 2/2006 | Chambers | A61G 7/05776 5/713 |
| 2008/0005847 | A1* | 1/2008 | Chambers | A61G 7/0514 5/713 |
| 2008/0005848 | A1* | 1/2008 | Chambers | A61G 7/0514 5/713 |
| 2008/0010752 | A1* | 1/2008 | Chambers | A61G 7/05776 5/713 |
| 2009/0070942 | A1 | 3/2009 | Chambers et al. | |
| 2009/0249552 | A1* | 10/2009 | Chambers | A61G 7/0507 5/713 |
| 2011/0047709 | A1 | 3/2011 | Tarsaud et al. | |
| 2021/0307982 | A1* | 10/2021 | Gowda | A61G 7/015 |

* cited by examiner

EXPANDABLE PATIENT SUPPORT APPARATUS AND METHOD

FIELD

The disclosure relates in general to patient support surfaces and, more particularly, to patient support surfaces including at least one inflatable portion controlled by a controller.

BACKGROUND

Patient support surfaces are known. Such patient support surfaces are constructed of inflatable portions such as bladders, foam, combination of air and foam, and other materials. Some patient support surfaces provide therapy for one or more medical conditions. Patient support surfaces may be expandable. For example, a mechanical valve such as a turn valve may be used to mechanically inflate and/or deflate certain portions of the patient support. Using the mechanical valve, a user may expand or retract the patient support apparatus. For example, a first valve may be used to expand a length of the patient support apparatus and a second valve may be used to expand a width of the patient support apparatus. However, a user may be required to individually and manually adjust the different valves from the different areas of the patient support surface where the valves are located which is cumbersome and time consuming for busy patient care givers in hospitals and other facilities. For example, a caregiver may need to turn a valve at a foot end of the bed to adjust length, and/or walk to sides of the bed to adjust a left side or right side valve to adjust bed width. Accordingly, there exists a need for one or more improved methods and/or apparatus in order to address one or more of the above-noted drawbacks.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

Figure 1:
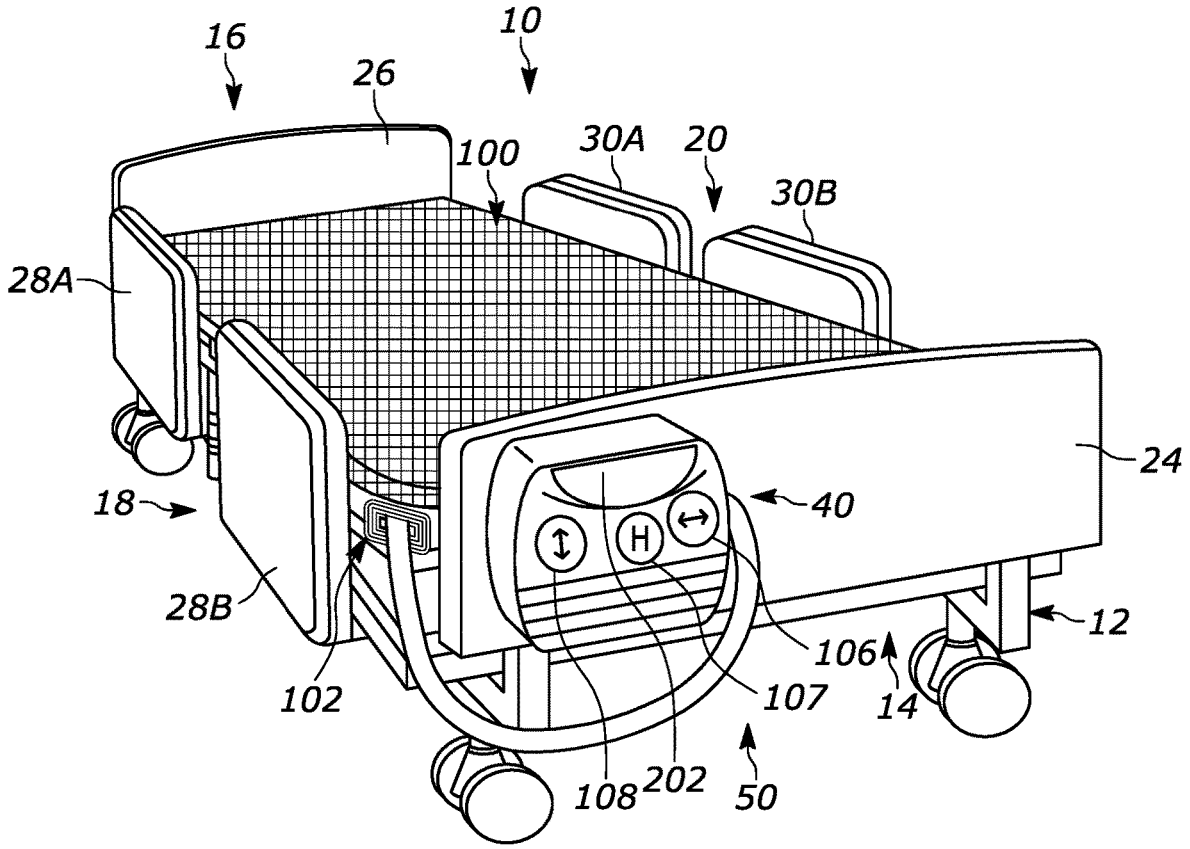
FIG. 1 is a perspective view of an exemplary bed including an exemplary patient support positioned thereon.

The embodiments disclosed herein are not intended to be exhaustive or to limit the invention to the precise forms disclosed in the following detailed description. Rather, the embodiments are chosen and described so that others skilled in the art may utilize their teachings.

In some examples, a device automatically inflates and/or deflates the patient support apparatus from a single location using the singular device. In certain examples, a patient support surface includes a controller that provides control of inflating and deflating inflatable portions. The controller controls both inflating and deflating a first set and a second set of inflatable portions in response to electronic control signals from a user interface device, such as a control panel. By inflating and deflating the first set of inflatable portions, the controller provides control of an adjustable width of the patient support surface. By inflating and deflating the second set of inflatable portions, the controller provides control of an adjustable length of the patient support surface. In other words, the width and length are adjustable by changing an amount of fluid in each of the first and second inflatable portions. Additionally, and/or alternatively, controller controls both inflating and deflating a third set of inflatable portions in response to electronic control signals from a user interface device. By inflating and deflating the third set of inflatable portions, the controller provides control of an adjustable height of the patient support surface.

Using a patient support surface with adjustable length, width, and/or height based on electronic control signals from the user interface device will help consolidate various types and sizes of surfaces/mattresses into a single support surface/mattress to accommodate different types of patients (e.g., pediatric, standard, and bariatric). Additionally, it will provide multiple therapies to the patient such as alternating pressure therapy, rotation therapy, low air loss therapy, immersion therapy, pulsation/wave therapy, and turn assist therapy.

Furthermore, the variable size of patient support surface will assist patients to be moved while in their beds to various locations in a facility (in elevators, through narrow doorways) for any procedures, without removing them of the bed and on to another transfer equipment. This patient support surface will allow caregivers to leave their patients in their beds, and move them around the facility with ease by just pressing a button on the user interface device. This patient support surface will automatically retract support surface/mattress on the bed frame to a transport size so that the caregiver will be able to move the patients into an elevator or through narrow doorways.

The patient support surface may reduce a facility's inventory by having one patient support surface, which will accommodate different size bed frames. The patient support surface will also help caregivers choose the right therapy patient support surface, and also help them from not manually expanding and retracting the patient support surface every time they have to move bariatric patients to different locations in the facility for various procedures.

Referring to FIG. 1, an exemplary bed 10 is shown. Bed 10 includes a bed frame 12. The bed frame 12 having a foot end 14, a head end 16, a first side 18 and a second side 20. A footboard 24 is positioned at the foot end 14 of the bed frame 12. A headboard is positioned at the head end 16 of bed frame 12. A plurality of side barriers 28A and 28B are positioned along the first side 18 of bed frame 12. A plurality of side barriers 30A and 30B are positioned along the side safety panels 20 of bed frame 12. Exemplary side barriers include side rails and other exemplary members to prevent egress of a patient.

A patient support surface 100 is supported on bed frame 12. As shown in FIG. 1, patient support surface 100 is positioned between side barriers 28 and side barriers 30 and between footboard 24 and headboard 26. An extendable width length height (EWLH) controller 40 is also supported by bed frame 12. The EWLH controller 40 interacts with one or more components of patient support surface 100 through an interface 102.

The EWLH controller 40 is any suitable controller, processor, device, apparatus, and/or other logic configuration used to control one or more operations of the patient support surface 100. In this example, the controller includes a housing that includes a user interface, air pump, circuitry, valves and other components to control a patient support. For example, the EWLH controller 40 is configured to inflate and/or deflate one or more inflatable portions of the patient support surface 100 using one or more programmed processors, application specific integrated circuits, programmable gate arrays or other suitable logic. By inflating and/or deflating the inflatable portions, the EWLH controller 40 is configured to control the width, length, and/or height of the patient support surface 100. The EWLH controller 40 uses a user interface device 104 to receive user inputs to control the width, length, and/or height of the patient support surface 100. For example, the user may use input selection devices 106 and/or 108 to extend and/or retract one or more inflatable portions of the patient support surface 100. This will be explained in further detail below.

In some instances, the EWLH controller 40 and/or the user interface device 104 is separated from patient support surface 100 and/or each other. For example, another device such as a mobile device, such as a smartphone, may include the user interface device 104. The other device receives user inputs and/or selections and then wirelessly provides the user inputs to the EWLH controller 40. Using the user inputs, the EWLH controller 40 controls the operation of the patient support (e.g., extending and/or retracting the patient support surface 100).

Figure 2:
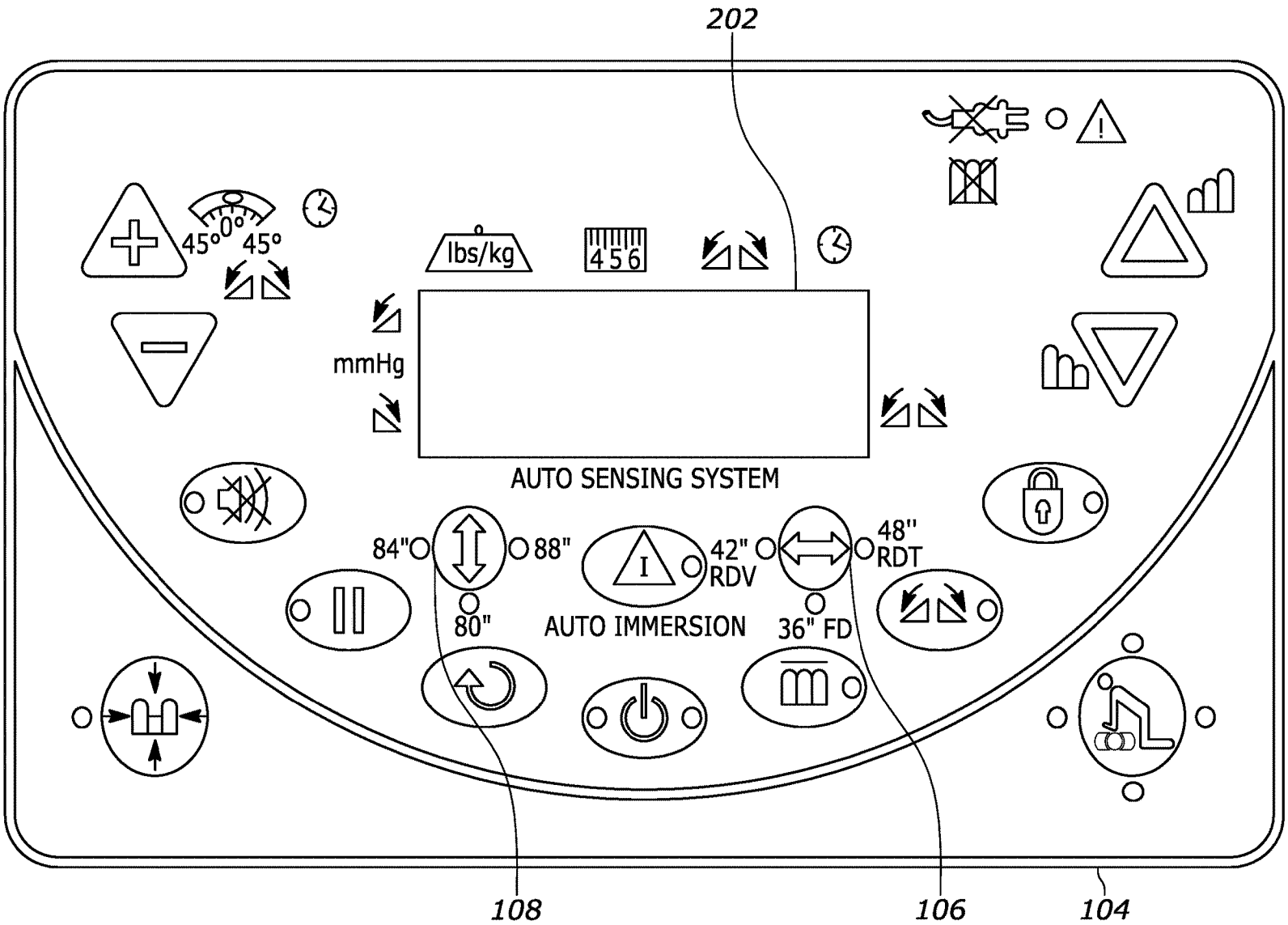
FIG. 2 is an exemplary user interface device for controlling the exemplary patient support of FIG. 1.

FIG. 2 shows an exemplary user interface device 104 of the EWLH controller 40. For example, the user interface device 104 includes one or more user input selection devices such as device 106 and 108. User input selection devices include, but are not limited to, levers, buttons, switches, selectors, knobs, and other suitable input devices whether graphical on a touch screen or mechanical. In this example, the user interface device 104 includes a user interface screen 202. The user interface screen 202 displays information to the user. In some examples, the user interface 202 is a touch-screen or portion thereof. The user interface device 104 includes selectable sections that are used to control the operation of the patient support surface 100. In will be recognized that any suitable form of user interface may be employed, and that the user interface may also be a remote user interface (e.g., an app on a smartphone).

In this example, the user interface device 104 includes user input selection device 106, such as one or more push buttons, sliders, graphical user interface elements or other structures, to control a width, such as a button to control inflation and deflation from 42" to 48", input selection device 108 to control length, such as button to control length to three lengths of 80", 84" and 88". The user interface also includes, in some implementations, a selection device 107 (see FIG. 1) to control height of the patient support surface 100. For example, a user may use the user input selection devices 106 and/or 108 to adjust a configuration (e.g., width and length) of the patient support surface 100. In other words, in response to actuation of a user input selection device such as device 106, the user interface device 104 provides the user input signals to the EWLH controller 40. The EWLH controller 40 determines one or more portions of the patient support surface 100 to inflate and/or deflate based on the received user input signals. By inflating and/or deflating one or more portions, the EWLH controller 40 changes the configuration of the patient support surface 100.

In some examples, the EWLH controller 40 includes memory that stores executable instruction that cause the controller to carry out the operations described herein and in one example also stores configuration data such as one or more configurations for the patient support surface 100. The EWLH controller 40 retrieves the configurations from memory and adjusts the configuration of the patient support surface 100 based on the retrieved configurations and the user input.

Figure 3:
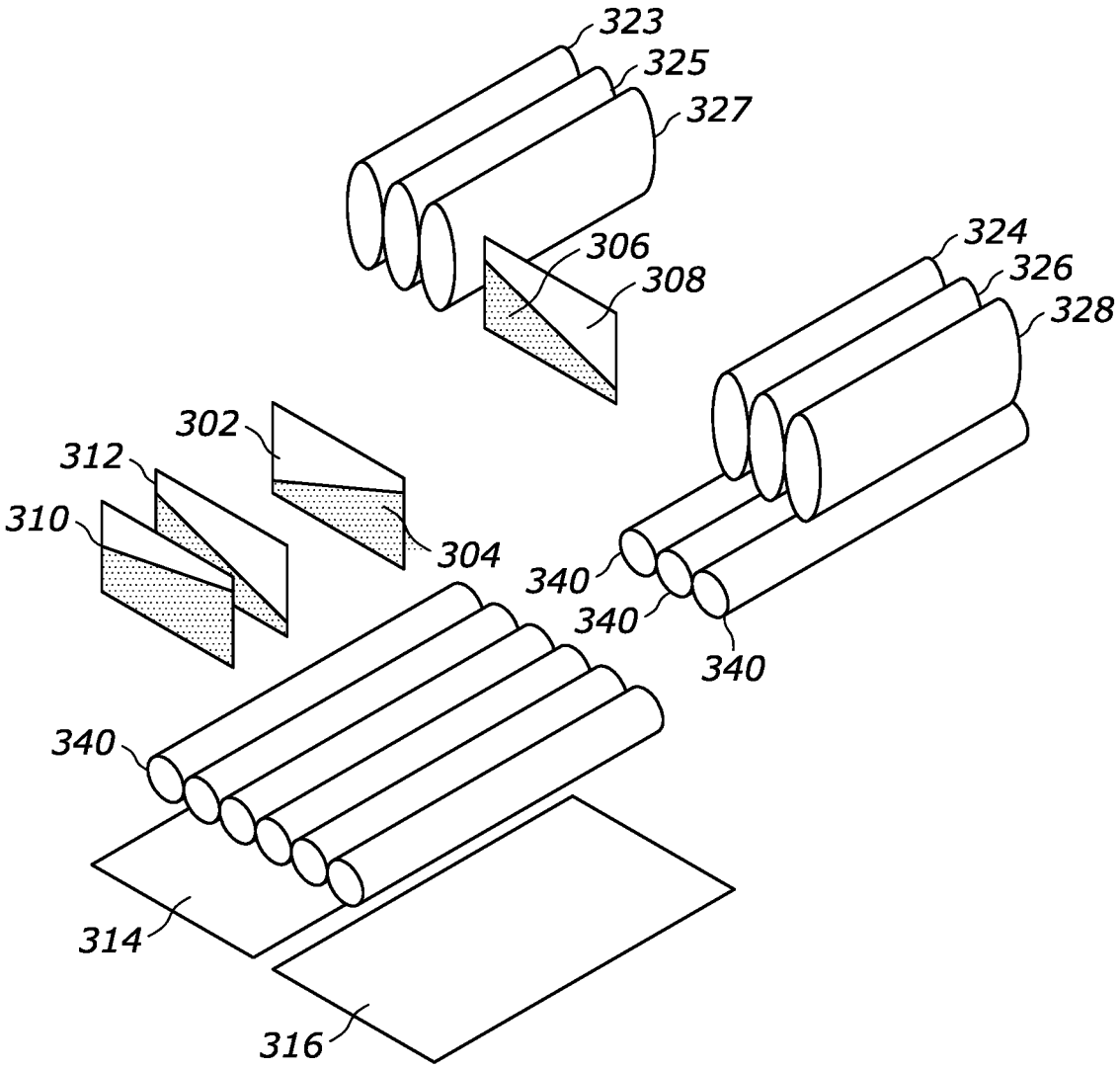
FIG. 3 is an exploded assembly view of multiple inflatable portions of the patient support of FIG. 1.

FIG. 3 shows an exploded assembly view of multiple inflatable portions of the patient support surface 100. For example, inflatable portions 302-328 are shown. The inflatable portions 302-328 are inflated and/or deflated based on user input from the user interface device 104. For example, certain inflatable portions 302-328 are inflated and/or deflated depending on user needs. Other cushions such as section 340 are safety supports and are not adjusted in some implementations. To assist a caregiver in taking care of a patient, the caregiver may increase and/or decrease the width, and/or length, and/or height of the patient support surface 100. For example, if the caregiver needs to move a patient from one room to another, the caregiver may use the user interface device 104 to decrease the width, length, and/or height of the patient support surface 100 to fit through the doorway. Afterwards, the caregiver may use the user interface device 104 to increase the width, length, and/or height of the patient support surface 100. Using the user interface device 104 may help facilitate the ease of changing the configuration of the patient support surface 100.

To assist the caregiver, the patient support surface 100 includes certain inflatable portions such as 310-328 that can be alternated between inflated and deflated states based on user (e.g., caregiver) needs. The patient support surface 100 may also include additional inflatable portions such as "Z" cells 302-308 (additional cells not shown) that are inflated and provide a primary support surface for the patient. Then, the inflatable portions 310-328 are inflated and/or deflated based on user input from the user interface device 104 to adjust height and/or length and/or width of the overall patient support. For example, in response to receiving user input from length selection input device 108 indicating to increase the length of the patient support surface 100, the EWLH controller 40 provides instructions to inflate the inflatable portions 310 and/or 312. In response to receiving user input indicating to increase the width of the patient support surface 100 from width selection input device 106, the EWLH controller 40 provides instructions to inflate one or more of the inflatable portions 323-328. Similarly, in response to receiving user input indicating to increase the height of the patient support surface 100 from height selection input device 107, the EWLH controller 40 provides instructions to inflate one or more of the inflatable portions 314 and 316. The user interface allows the user to deflate the inflatable portions in a corresponding manner as well through the controller 40. In this example the inflatable portions 340 and or 314 and 316 are implemented as a low air loss membrane or a sonic membrane as desired. However, any suitable inflation structure may be employed.

Figure 4:
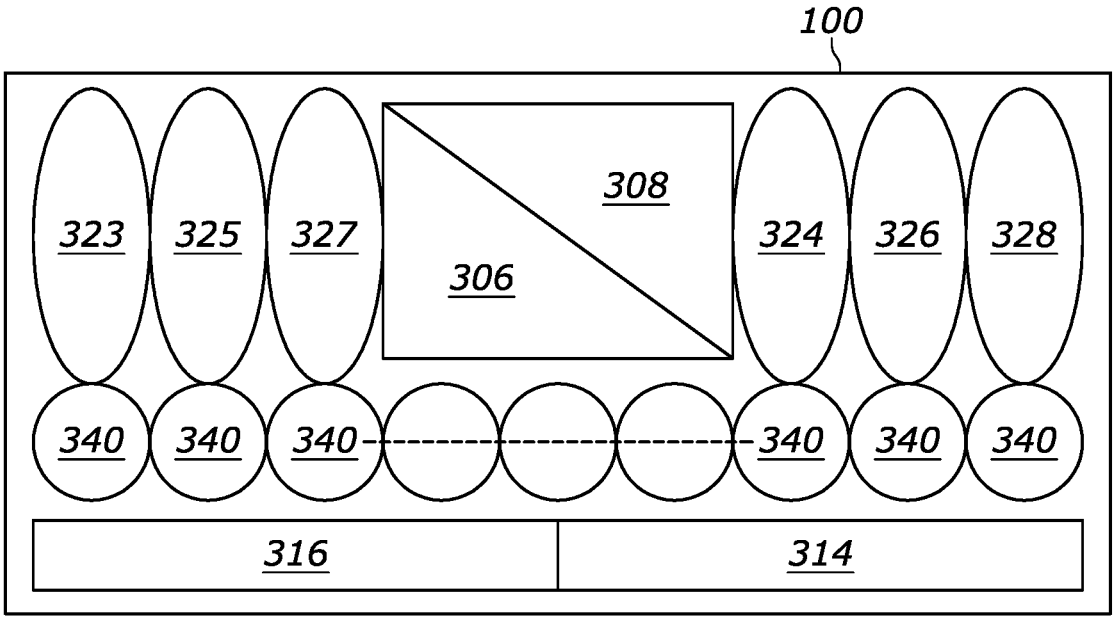
FIG. 4 is a cross-sectional view of the inflatable portions of the patient support of FIG. 1.

FIG. 4 shows a cross-sectional view of the patient support surface 100 including the inflatable portions shown in FIG. 3. For example, FIG. 4 shows the inflatable portions 323-328 that are inflated and/or deflated to increase and/or decrease the width of the patient support surface 100. The inflatable portions 314, and 316 are inflated and/or deflated to increase and/or decrease the height of the patient support surface 100. FIGS. 3 and 4 show only an exemplary configuration of inflatable portions of the patient support surface 100. In other examples, the patient support surface 100 may include additional and/or less inflatable portions for controlling the width, length, and/or height of the patient support surface 100.

Figure 5:
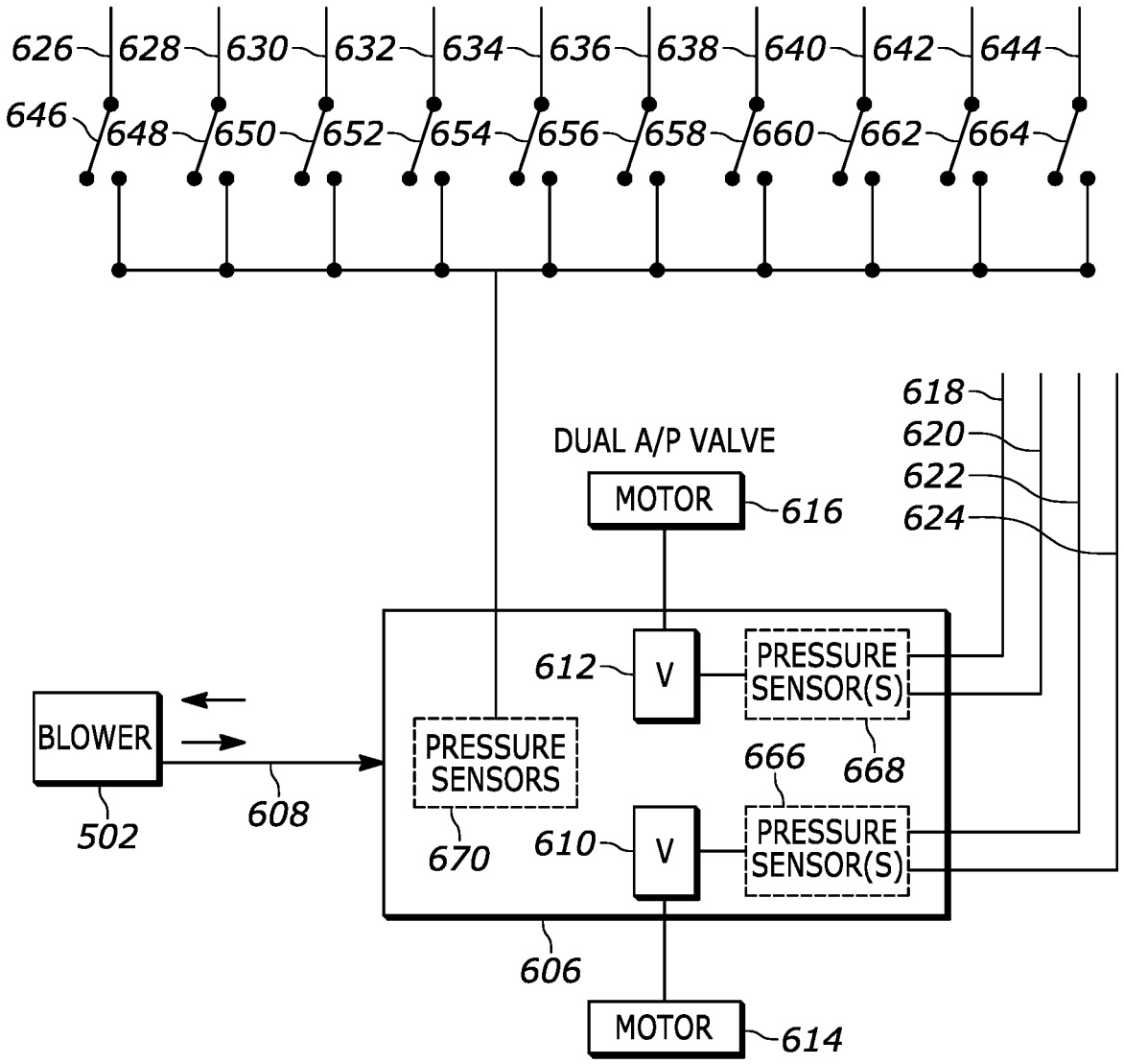
FIG. 5 is an exemplary pneumatic block diagram for the patient support of FIG. 1 including a plurality of valves, a blower, and a motor.

FIG. 5 shows a pneumatic block diagram for the patient support surface 100 including a plurality of valves and a centrifugal blower. For example, the blower 502 (e.g., an air pump) is used to provide fluid such as air to the inflatable portions 302-328. The blower 502 is fluidly connected 608 to valve apparatus 606. In other words, the blower 502 provides fluid to the valve apparatus 606. The valve apparatus 606 includes two valves 610 and 612. The two valves 610 and 612 are operatively connected and controlled by stepper motors 614 and 616. The motors 614 and 616 are in electrical communication with the EWLH controller 40. In this example, valve 610 in controlled to provide fluid flow from 608 to tube 622 which provides fluid flow to/from the width cells 323, 325 and 327 and tube 624 which provides fluid flow to/from width cells 324, 346 and 348. Valve 612 is controlled via motor 616 to provide fluid flow to/from tubes 618 and 620 each of which provide fluid to length cells 310 and 312 respectively. Other valves 646-664 are controlled by the controller to provide fluid flow for respective tubes 626-644 that are connected to the height cells, the cells 340 and the primary support cells 302-304. It will be recognized that any suitable fluid flow architecture may be employed as desired.

The EWLH controller 40 provides instructions to the motors 614, and/or 616 to inflate one or more inflatable portions. For instance, the user may seek to inflate the patient support surface 100 such that a patient may lie on it. Using the user interface device 104, the user may provide user input to inflate the patient support surface 100. The EWLH controller 40 provides the instructions to inflate portions using the pneumatic configuration (e.g., blower 502 provides air through the tubes 608 and 618-644).

By closing and/or opening the valves 610, 612 and 646-664, the EWLH controller 40 controls the width, length, and/or height of the patient support surface 100 based on the user inputs. The valve apparatus 606 optionally includes pressure sensors 666-670. When present, the pressure sensors 666-670 monitor the pressure of the fluid through the tubes 618-624 and 626-644. The pressure sensors 666-670 provide the sensor information sensed in the tubes 618-624 and 626-644 to the EWLH controller 40.

Figure 6:
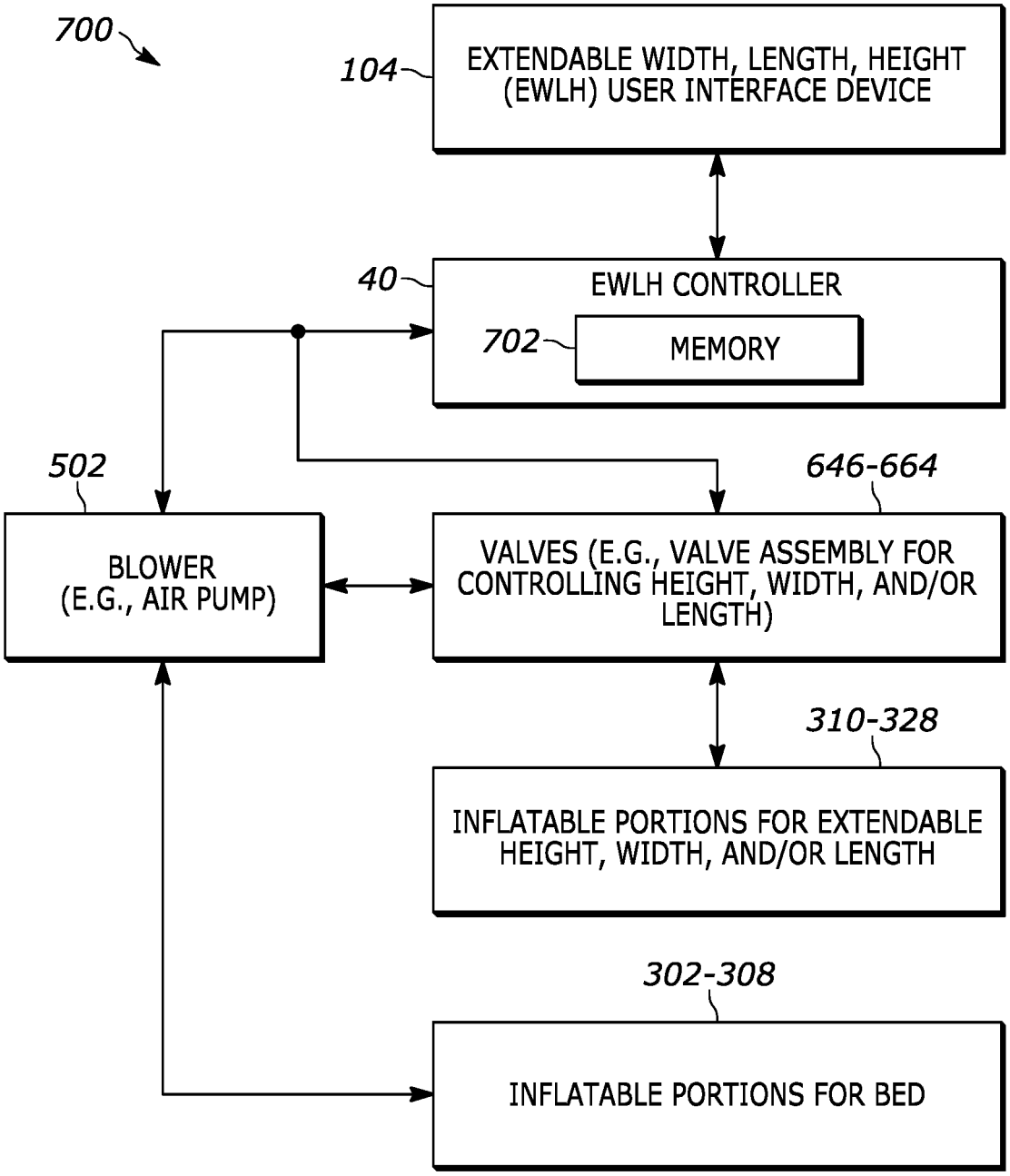
FIG. 6 is an exemplary block diagram for controlling the inflatable portions of the patient support of FIG. 1.

FIG. 6 shows a block diagram 700 for controlling the width, length, and height of the patient support surface 100. For example, block diagram 700 is an electrical block diagram for adjusting the configuration of the patient support surface 100 (e.g., inflating and/or deflating the inflatable portions 302-328). The block diagram 700 includes the EWLH user interface device 104, the EWLH controller 40, the blower (e.g., air pump) 502, the valves (e.g., the valve assembly for controlling the height, width, and/or length) 646-664, the inflatable portions for extendable height, width, and/or length 310-328, and the inflatable portions for the bed 302-308. These components are described above in FIGS. 1-5. The controller 40 includes memory 702. The memory 702 is non-transitory memory having instructions that, in response to execution by a processor (e.g., the controller 40), cause the processor to control the operation of the patient support surface 100.

Figure 7:
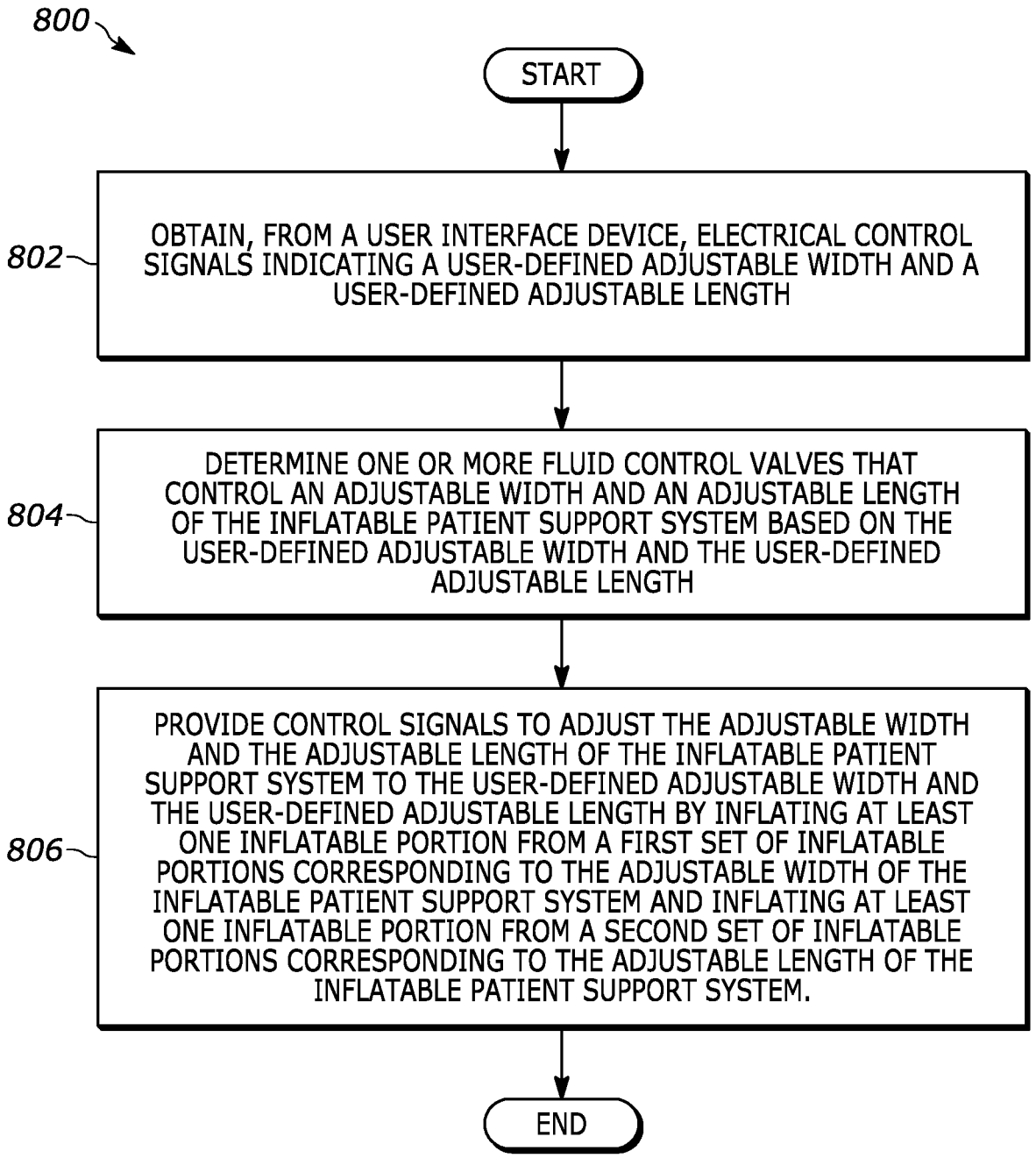
FIG. 7 is an exemplary processing sequence for controlling the inflatable portions of the patient support of FIG. 1.

FIG. 7 shows a processing sequence 800 for adjusting the configuration of the patient support surface 100 based on user input. FIG. 7 will be described with reference to FIGS. 1-6. In operation, at step 802, the EWLH controller 40 obtains, from the user interface device 104, electrical control signals indicating a user-defined adjustable width and a user-defined adjustable length. For instance, the user uses the input selection devices 106 and/or 108 of the user interface device 104 to provide user-defined adjustable widths and/or lengths. The user interface device 104 provides these electrical control signals to the EWLH controller 40.

At step 804, the EWLH controller 40 determines one or more fluid control valves (e.g., valves 646-664) that control an adjustable width and an adjustable length of the patient support surface 100. At step 806, the EWLH controller 40 provides, to the one or more determined fluid control valves 646-664, control signals to adjust the adjustable width and the adjustable length of the patient support surface to the user-defined adjustable width and the user-defined adjustable length by inflating at least one inflatable portion from a first set of inflatable portions corresponding to the adjustable width of the patient support surface 100 and inflating at least one inflatable portion from a second set of inflatable portions corresponding to the adjustable length of the patient support surface 100.

In other words, the patient support surface 100 includes a fluid support surface. The fluid support surface includes the inflatable portions 302-328 that are used to adjust the length, width, and/or height of the patient support surface 100. For instance, the fluid support surface may include different sets of inflatable portions. The controller 40 may adjust the width by inflating and/or deflating a first set of inflatable portions (e.g., inflatable portions 324, 326, and 328). The controller 40 may adjust the length by inflating and/or deflating a second set of inflatable portions (e.g., inflatable portions 310 and/or 312). The controller 40 may adjust the height by inflating and/or deflating a third set of inflatable portions (e.g., inflatable portions 318, 320, 322, 314, and/or 316). For example, by providing electrical control signals to the valves 646-664, the controller 40 inflates and/or deflates the inflatable portions 302-328.

In some examples, the EWLH controller 40 also controls a height of the patient support surface 100. For example, the EWLH controller 40 obtains, from the user interface device 104, electrical control signals indicating a user-defined height. The EWLH controller 40 determines one or more control valves to adjust the adjustable height of the patient support surface and provides control signals to these determined control valves.

In some instances, the processing sequence 800 repeats. For example, after moving the patient support surface 100 through the doorway, the caregiver may seek to extend the patient support surface 100 and provide one or more user inputs indicating another user-defined width, length, and/or height. The EWLH controller 40 receives a second set of user-defined widths, lengths, and/or heights. Then, based on the second user inputs, the EWLH controller 40 determines the control valves and provides control signals to the determined control valves.

In some variations, the memory 702 stores the configurations of the patient support surface 100 (e.g., the adjustable lengths, widths, and heights). The EWLH controller 40 retrieves these stored configurations and compares them with the user input to determine the control valves 646-664 used to adjust the width, length, and/or height. The EWLH controller 40 then provides control signals based on the determined control valves.

Figure 8:
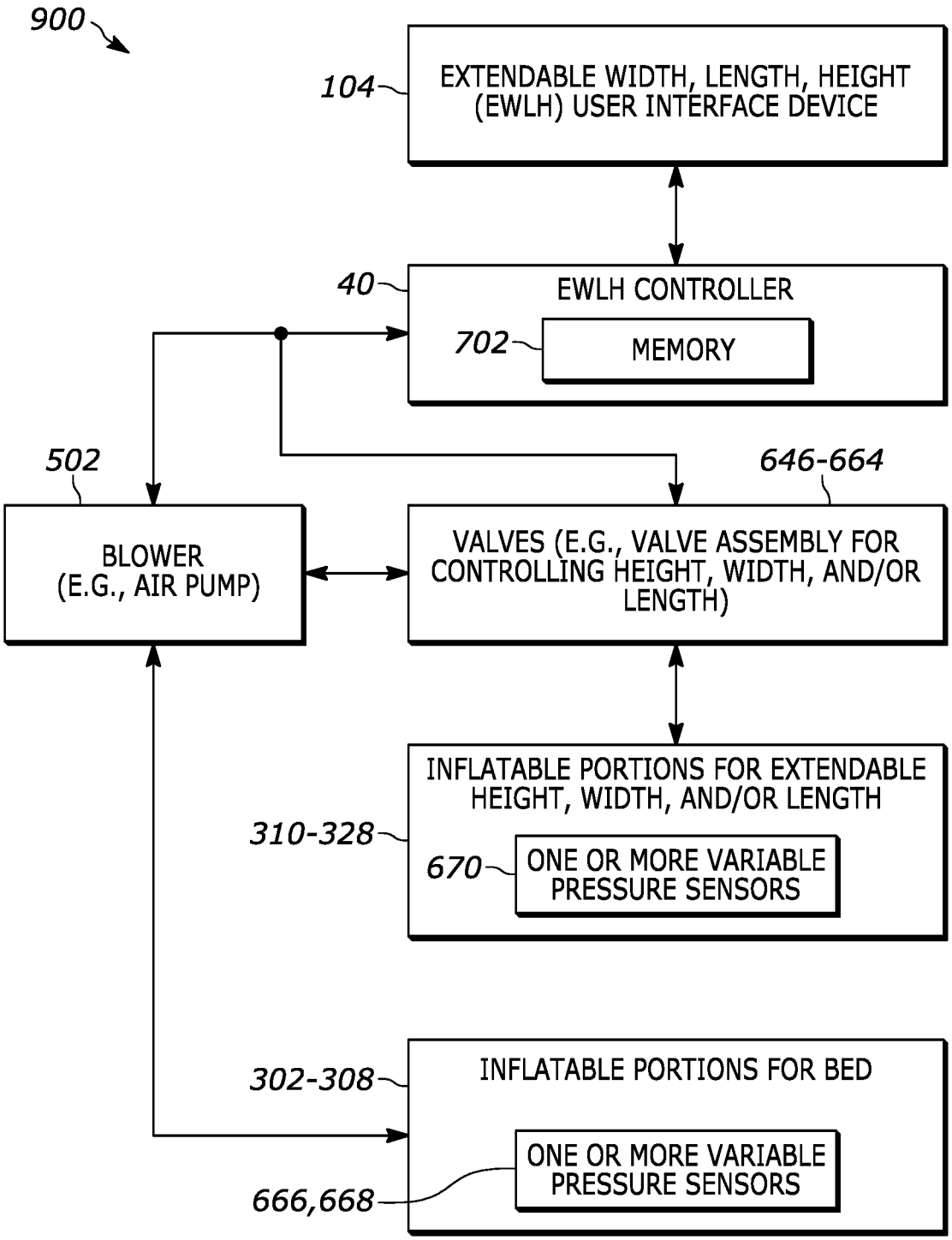
FIG. 8 is another exemplary block diagram for controlling the inflatable portions of the patient support of FIG. 1.

FIG. 8 shows another block diagram 900 for controlling the width, length, and height of the patient support surface 100. For example, block diagram 900 is similar to block diagram 700 except block diagram 900 includes the pressure sensors 666, 668, and 670 from FIG. 5. For example, the pressure sensors 666, 668, and 670 provide pressure readings of the inflatable portions 302-328 to the EWLH controller 40. The EWLH controller 40 adjusts the fluid in the inflatable portions 302-328 based on the pressure readings.

In other words, the EWLH controller 40 controls an amount of fluid to the inflatable portions 302-328 using the pressure readings from the pressure sensors 666, 668, and 670. For instance, the patient may be situated in a certain location of the patient support system 100. Based on the location of the patient, some inflatable portions 302-328 may have more pressure than other inflatable portions 302-328. The EWLH controller 40 receives pressure readings from the pressure sensors 666, 668, 670 indicating the location of the patient. Then, the EWLH controller 40 controls the opening of the valves 646-664 and/or the air blower 502 to permit an additional amount of fluid from the air blower 502 to the inflatable portions 302-328. For example, the EWLH controller 40 controls the valve 646-664 such that more fluid reaches the inflatable portions 302-328 where the patient is currently located.

While this disclosure includes particular examples, it is to be understood that the disclosure is not so limited. Numerous modifications, changes, variations, substitutions, and equivalents will occur to those skilled in the art without departing from the spirit and scope of the present disclosure upon a study of the drawings, the specification, and the following claims.

The invention claimed is:

1. A support surface comprising:

a patient fluid support surface comprising a first set of inflatable portions having an adjustable width and a second set of inflatable portions having an adjustable length, the width and length both adjustable by changing an amount of fluid in each of the first and second inflatable portions, a third set of inflatable portions, positioned below the second set of inflatable portions, having an adjustable height, the height being adjustable by changing an amount of fluid in the third set of inflatable portions; and a controller housing comprising:

a user interface device; and a controller operative to provide control of both inflating and deflating of the first and second sets of inflatable portions in response to electronic control signals from the user interface device and wherein the controller is operative to provide control of both inflating and deflating of the third set of inflatable portions in response to electronic control signals from the user interface device.

2. The support surface of claim 1, wherein the user interface device comprises a plurality of user selections corresponding to a length setting for the second set of inflatable portions and a width setting for the first set of inflatable portions.

3. The support surface of claim 1, wherein the electronic control signals indicate a user input width selection for the first set of inflatable portions and a user input length selection for the second set of inflatable portions, and wherein the controller receives, from the user interface device, the user input width selection for the first set of inflatable portions and the user input length selection for the second set of inflatable portions.

4. The support surface of claim 3, wherein the controller is configured to control the first and second set of inflatable portions by:

determining, based on user input width selection, one or more first control valves corresponding to the first set of inflatable portions;

determining, based on user input length selection, one or more second control valves corresponding to the second set of inflatable portions;

providing one or more first control signals to the one or more first control valves to inflate at least one inflatable portion from the first set of inflatable portions; and providing one or more second control signals to the one or more second control valves to inflate at least one inflatable portion from the second set of inflatable portions.

5. The support surface of claim 4, wherein the controller is configured to receive a second electronic control signal from the user interface device indicating a second user input width selection, and wherein the controller is further configured to:

determine, based on second user input width selection, one or more third control valves corresponding to the first set of inflatable portions; and provide one or more third control signals to the one or more third control valves to deflate at least one inflatable portion from the first set of inflatable portions.

6. The support surface of claim 4, wherein the controller is configured to receive a second electronic control signal from the user interface device indicating a second user input length selection, and wherein the controller is further configured to:

determine, based on second user input length selection, one or more third control valves corresponding to the second set of inflatable portions; and provide one or more third control signals to the one or more third control valves to deflate at least one inflatable portion from the second set of inflatable portions.

7. The support surface of claim 1, wherein the patient fluid support surface further comprises a plurality of pressure sensors configured to monitor and provide pressure readings to the controller, and wherein the controller is configured to control the amount of fluid to each of the first and second set of inflatable portions based on the pressure readings from the plurality of pressure sensors.

8. A method for inflating a patient support surface comprising:

obtaining, from a user interface device and by a controller, electrical control signals indicating a user-defined adjustable width, a user-defined adjustable length and a user defined adjustable height;

determining one or more fluid control valves that control an adjustable width, an adjustable length and an adjustable height of the patient support surface based on the user-defined adjustable width and the user-defined adjustable length; and providing, to the one or more determined fluid control valves, control signals to adjust the adjustable width, the adjustable height and the adjustable length of the patient support surface to the user-defined adjustable width and the user-defined adjustable length by inflating at least one inflatable portion from a first set of inflatable portions corresponding to the adjustable width of the inflatable patient support surface, inflating at least one inflatable portion from a second set of inflatable portions corresponding to the adjustable length of the inflatable patient support surface and inflating at least one inflatable portion from a third set of inflatable portions corresponding to the adjustable height of the inflatable patient support surface, the third set of inflatable portions being below the second set of inflatable portions.

9. An apparatus comprising:

a controller operative to control a support surface system that includes a first set of inflatable portions having an adjustable width, a second set of inflatable portions having an adjustable length, a third set of inflatable portions, positioned below the second set of inflatable portions, having an adjustable height, the height being adjustable by changing an amount of fluid in the third set of inflatable portions, the width and length both adjustable by changing an amount of fluid in each of the first and second sets of inflatable portions; and a user interface, operatively coupled to the controller, configured to provide electronic control signals to the controller that cause the controller to adjust the first set of inflatable portions having the adjustable width, the second set of inflatable portions having the adjustable length and the third set of inflatable portions.

10. An apparatus comprising:

a controller operative to control a support surface system that includes a first set of inflatable portions having an adjustable width, a second set of inflatable portions having an adjustable length, a third set of inflatable portions, positioned below the second set of inflatable portions, having an adjustable height, the height being adjustable by changing an amount of fluid in the third set of inflatable portions, the width and length both adjustable by changing an amount of fluid in each of the first and second sets of inflatable portions, the controller operative to receive electronic control signals from a user interface that cause the controller to adjust the first set of inflatable portions having the adjustable width and the second set of inflatable portions having the adjustable length and the third set of inflatable portions.

* * * * *